United States Patent [19]

Keller

[11] 4,325,241

[45] Apr. 20, 1982

[54] SYSTEM FOR THE INCREASE OF THE NUMBER OF DIFFERING LOCKING POSSIBILITIES IN ROTARY CYLINDER LOCKS

[76] Inventor: Ernst Keller, Untere Schwandenstrasse 22, 8805 Richterswil, Switzerland

[21] Appl. No.: 171,233

[22] Filed: Jul. 21, 1980

[30] Foreign Application Priority Data

Apr. 24, 1979 [CH] Switzerland ..... 3851/79

[51] Int. Cl.[3] ..... E05B 27/04

[52] U.S. Cl. ..... 70/358; 70/364 A; 70/378; 70/409

[58] Field of Search ..... 70/358, 364 A, 378, 70/405, 406, 407, 409, 411, 392

[56] References Cited

U.S. PATENT DOCUMENTS

| | | | |
|---|---|---|---|
| 1,644,365 | 10/1927 | Bennett | 70/409 |
| 3,393,542 | 7/1960 | Crepinsek | 70/358 |
| 3,738,136 | 6/1973 | Falk | 70/363 |
| 3,797,520 | 12/1973 | Crepinsek | 70/358 |

*Primary Examiner*—Robert L. Wolfe

*Attorney, Agent, or Firm*—Browdy and Neimark

[57] ABSTRACT

In rotary cylinder locks with spring-loaded, two-piece tumbler pins which are disposed radially to the lock cylinder and which interact with recesses 9, 10, 11 arranged in the side surfaces of flat keys 4, some of the recesses 10, 11 are disposed in steps. In this manner, one recess (for instance 10) shows differing control surfaces 10*a,* 10*b,* 10*c,* which can interact with differently disposed inner pins. By omitting some control surfaces (for instance 10*a*), auxiliary or single keys can be created, which can only position part of all inner pins of the same group. In this manner the number of differing locking possibilities of such locks can be multiplied.

6 Claims, 9 Drawing Figures

SYSTEM FOR THE INCREASE OF THE NUMBER OF DIFFERING LOCKING POSSIBILITIES IN ROTARY CYLINDER LOCKS

FIELD OF INVENTION

The invention relates to locks, and, more particularly, to rotary cylinder locks.

BACKGROUND OF INVENTION

Rotary cylinder locks which are well known comprise spring-loaded two-piece tumbler pins disposed in bores running radially to the cylinder core and cylinder housing. These pins are positioned by a flat key to permit free movement of the cylinder core, the key being introduced into the key channel of the cylinder core to position the correct alignment of the tumbler pin rows by means of recesses in the pile surfaces thereof. Different locking possibilities are achieved in locks of this type having a given diameter of the cylinder core and the same cross section of the key channel, by the fact that the recesses in the lateral faces of the keys have differing depths and the inner pins of the two-piece tumbler pins are designed with different lengths.

Another increase in the locking possibilities can be achieved by designing the distance between the several tumbler pins at different lengths. Furthermore, the axial distance of the first tumbler pin from the key stop at the face of the inner cylinder can also be changed. It is further known from Swiss Pat. No. 432,279 to increase the number of locking possibilities by changing the radial distance of the key channel from the surface of the cylinder core.

Nevertheless, the number of possible locking differences according to the methods mentioned and so far known is often unsatisfactory in the case of locking systems for large buildings, such as factories, hotels or banks, where all or a majority of the locks are operated by master keys and where specific groups of locks and/or single locks are operated by auxiliary or single keys differing from each other and from the master key. In such locking systems it is often necessary to omit tumbler pins from certain locks, i.e. to equip only a part of the existing bores with tumbler pins. This, however, results in a lessening of the security value of a lock.

SUMMARY OF INVENTION

It is, accordingly, an object of the present invention to overcome deficiencies in the prior art such as mentioned above, and also to create an additional system for the increase of the number of locking possibilities, differing from one another, for rotary cylinder locks, which permits the increase of locking variables in a technically acceptable way, without having to omit, for instance, tumbler pins.

These objects are achieved by transfering the gradations, i.e. the differing lengths of the inner bolts of a lock, into a single recess with differing control surfaces. Of course, the above mentioned already known possibilities for increasing the locking variations can be used in addition to the concept of the invention.

It is already known from Swiss Pat. No. 524,749 to equip the recesses in the lateral sides of flat keys from the inside out with several adjacent pin control gradations. Such construction, however, has an entirely different purpose. The differing pin control gradations are supposed to interact with the tumbler pins, which consist of several single pins coaxially arranged within each other and equipped with individual springs. This is a very complex and expensive construction, and the use of differing tumbler pins, the heads of which interact, for instance, with only one of the control gradations, is not envisioned.

BRIEF DESCRIPTION OF DRAWINGS

The present invention is further explained by the use of an example shown in the drawing.

DETAILED DESCRIPTION OF A PREFERRED EMBODIMENT

Figure 1:
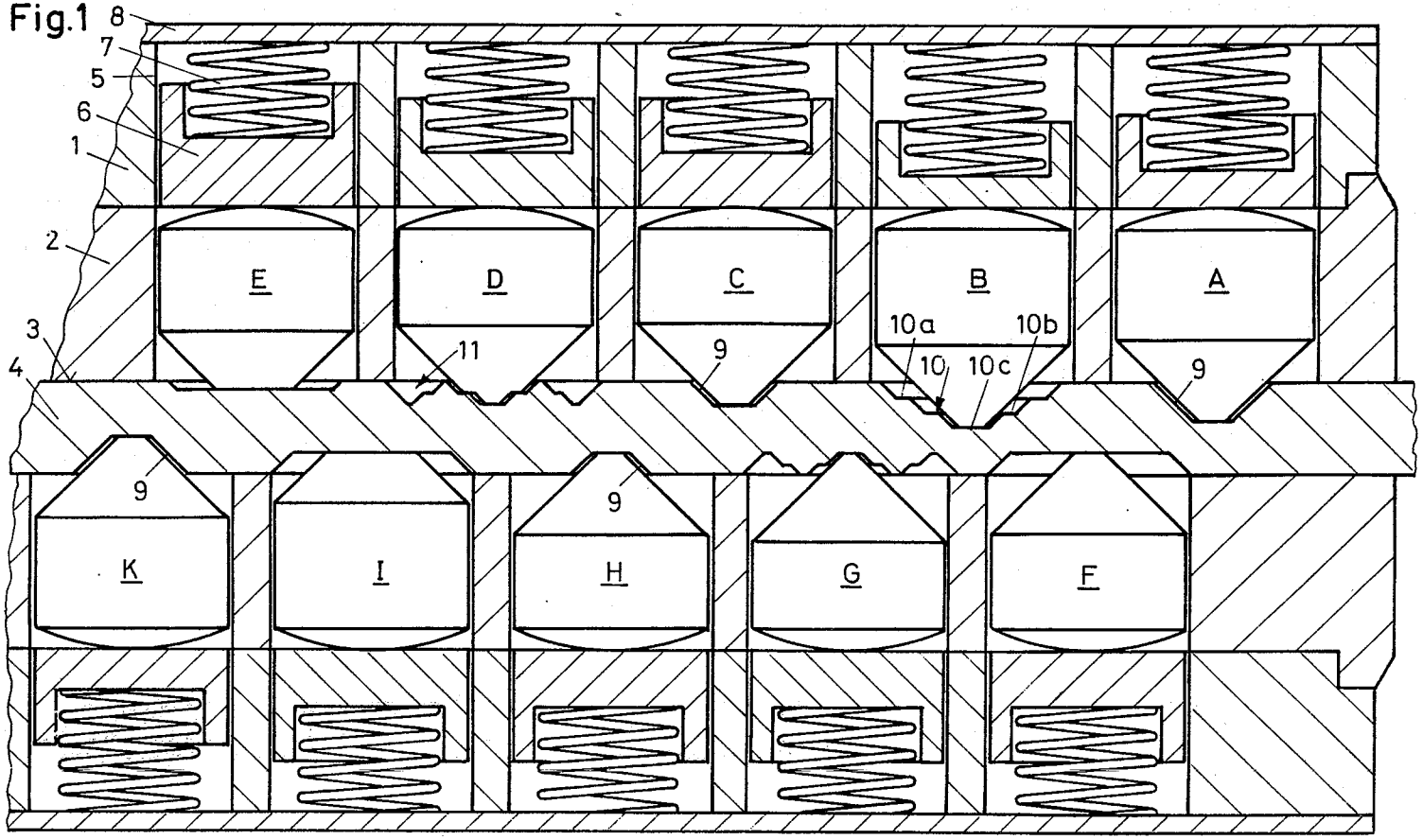
FIG. 1 shows a longitudinal cross section of a rotary cylinder lock with key inserted, wherein some of the recesses in the key show several differing control surfaces for the associated inner pins.

The lock cylinder of FIG. 1 shows in a known manner a static cylinder housing 1, in which a cylinder core 2 is movably disposed. A key 4 is inserted into the key channel 3 of the cylinder core. Housing 1 and core 2 have a plurality of radial bores 5, in each of which is slidably engaged a two-piece tumbler pin. The inner pins are labelled with the letters A-K. The outer pins 6 are simply distinguished by their different lengths. Furthermore, springs 7 are disposed in the bores 5, which are braced against a casing 8 and which are initially stressed and press against the outer pins 6, while the latter themselves press the inner pins A-K radially inwardly against the key 4.

The key 4 shows normal bore notches in part which are labelled 9 and which can, respectively, have a control surface of differing depths. The inner pins A, C, H and K engage the bore notches 9 of the key 4. A recess 10 in the key 4 is equipped with three differing control surfaces 10*a*, 10*b*, 10*c* for the inner pins.

Figure 2:
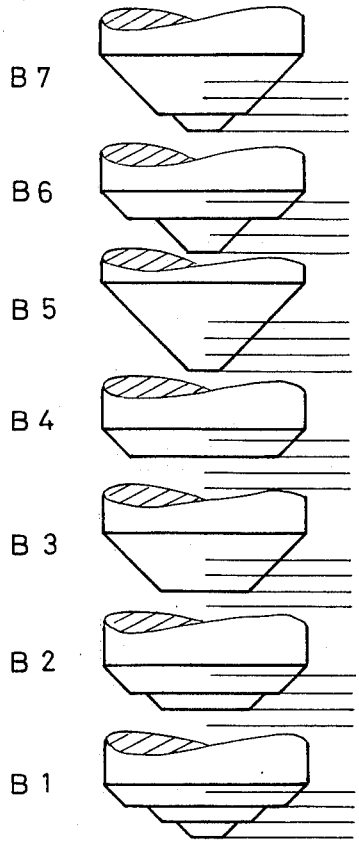
FIG. 2 shows the tips of seven different tumbler pins, which can interact with one of the recesses of the key according to FIG. 1.
Figure 3:
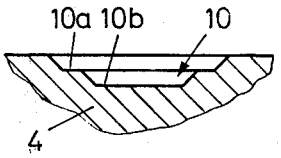
FIG. 3 shows a section of a key with a modified recess for some of the tumbler pins according to FIG. 2.

The heads of seven differing inner pins $B_1$ to $B_7$ are shown in FIG. 2, which can all be positioned by the recess 10. Pin $B_5$ is equivalent to pin B in FIG. 1. If recess 10 in key 4 is modified according to FIG. 3 by omitting the control surface 10*c*, then such keys can only position inner pins $B_2$, $B_3$ and $B_4$. Locks equipped with inner pins $B_1$, $B_5$, $B_6$ and $B_7$ therefore cannot be opened with keys 4 having a recess according to FIG. 3.

Figure 4:
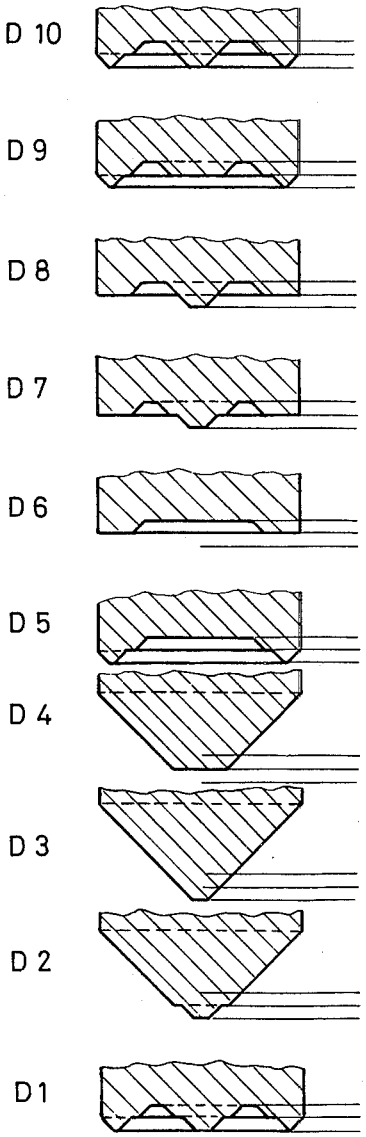
FIG. 4 shows the tips of ten different tumbler pins, which interact with another recess in the key.
Figure 5:
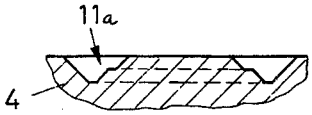
FIG. 5 shows a section of a key with a modified recess for some of the tumbler pins according to FIG. 4.

If a recess in key 4 is made in the manner of recess 11 (FIG. 1), the inner pins D, the heads of which show ten differing forms $D_1$ to $D_{10}$ according to FIG. 4, can be positioned by this recess 11. Pin $D_2$ is equivalent to the inner pin D in FIG. 1. If recess 11 in key 4 is modified, for instance, according to FIG. 5 to provide recess 11*a*, such a key can only position inner pins $D_5$ and $D_6$. By making other equivalent modifications of recesses 10 and 11 and the heads of the respective inner pins, a large number of additional locking variations can be created. The other side of the key can also be equipped with recesses, of course, which have differing control surfaces. The recess operating together with inner pin G, for example, is equivalent to recess 11 (FIG. 1).

Figure 7:
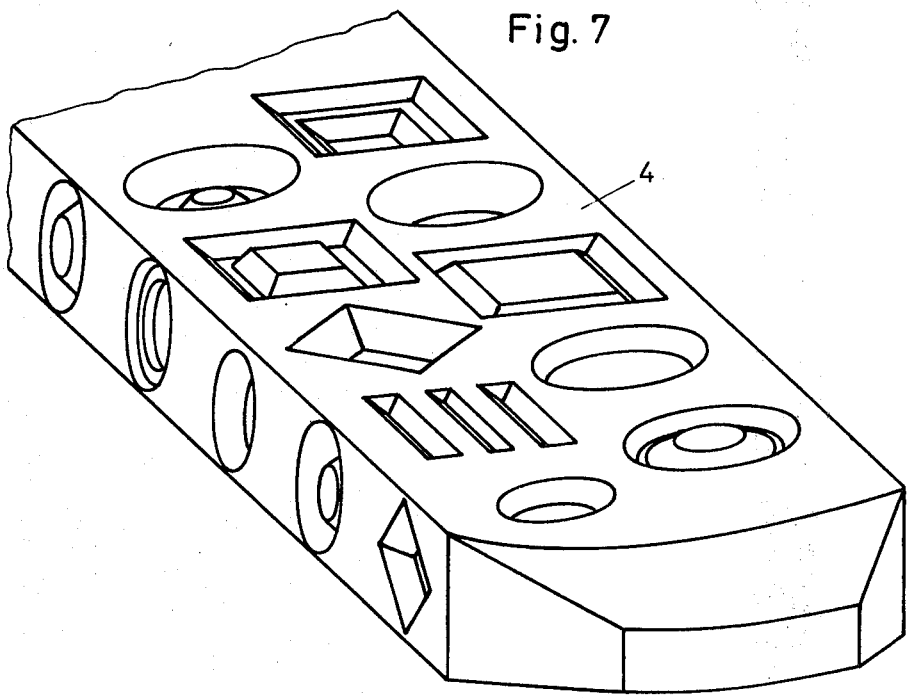
FIG. 7 shows a perspective view of the shank of a flat key with differing recesses.

The embodiment of the recesses according to the present invention can be further modified by not making the bores 5 in the cylinder round, but, for example, square, and by modifying the tumbler pins accordingly, so that they cannot turn in their bores. This permits the arrangement of recesses in the keys 4 according to FIGS. *6a, 6b.* The production of such recesses in the keys would be expensive, however, since they could not be bored or milled, but would have to be reamed or stamped. FIG. 7 shows a key with a multitude of recesses of differing shapes, some of which are also disposed on the surfaces of the narrow side of the key. The cross section of a key according to FIG. 8 discloses that recesses 12 can also be made for tumbler pins disposed obliquely to the side wall of the key.

Figure 6A:
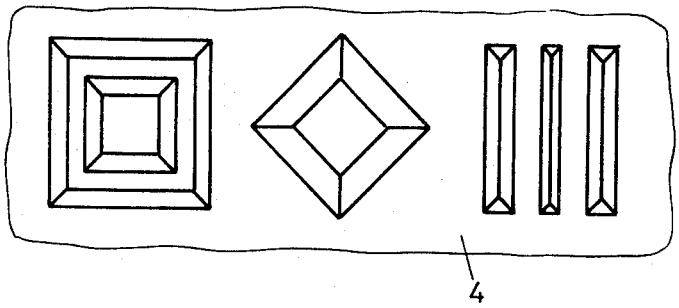
FIGS. 6*a*, 6*b* show a plan view and a longitudinal cross section of a section of a key with differing recesses.
Figure 8:
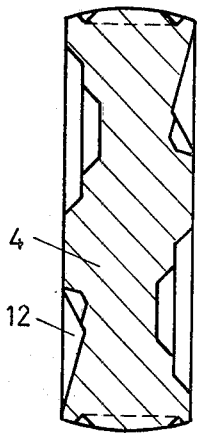
FIG. 8 shows a cross section of a key with recesses for tumbler pins running vertically and obliquely to the plane of the key.
Figure 6B:
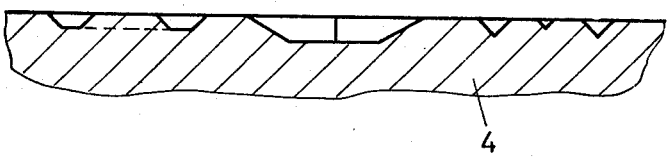

It should be clear that keys with several control surfaces, especially with those according to FIGS. 6, 7 and 8, can hardly be copied by unauthorized persons, which increases the security value of a cylinder considerably.

The foregoing description of the embodiment will so fully reveal the general nature of the invention that others can, by applying current knowledge, readily modify and/or adapt for various applications such specific embodiment without departing from the generic concept, and, therefore, such adaptations and modifications should and are intended to be comprehended within the meaning and range of equivalents of the disclosed embodiment. It is to be understood that the phraseology or terminology employed herein is for the purpose of description and not of limitation.

What is claimed is:

1. In a rotary cylinder lock comprising a cylinder housing, a cylinder core disposed therein and having a key channel, and a plurality of spring-loaded, two-piece tumbler pins disposed in bores running radially through the cylinder core and the cylinder housing and which can be positioned by a flat key in the key channel to permit free movement of the cylinder core and positions the correct alignment of rows of the tumbler pins by means of recesses in side surfaces of the key, the improvement comprising means for increasing the number of differing locking possibilities comprising variably shaped heads on the tip ends of said tumbler pins, and wherein at least one of the recesses of the key has two or more differing control surfaces for the head of the accompanying tumbler pin, and the heads of the respective tumbler pins in the several locks are disposed in such a manner that the heads are only arranged in the correct alignment when the heads interact with either one, several or all control surfaces at the same time.

2. A system comprising a plurality of locks according to claim 1 for locking systems with main, auxiliary and single keys, characterized by the fact that the keys for the several locks have, besides bore notches 9 with one control surface, also recesses 10, 11 with several control surfaces, for example, 10*a*, 10*b*, 10*c*, for the tumbler pins $B_1$ to $B_7$ or $D_1$ to $D_{10}$.

3. A lock according to claim 1 wherein the recesses in the key have concentric control surfaces.

4. A lock according to claim 1 wherein said tumbler pins are of polygonal cross section and the recesses in the keys are of polygonal shape with stepped control surfaces.

5. A system according to claim 2 wherein all recesses of the several keys are disposed in the same way, while the lengths and heads of the several tumbler pins are disposed variably.

6. A system according to claim 2 wherein the recesses in the several keys are disposed variably as to depth and design.

* * * * *